US011871885B2

(12) United States Patent
Ross et al.

(10) Patent No.: US 11,871,885 B2
(45) Date of Patent: Jan. 16, 2024

(54) RESERVOIR MOP AND RELATED METHOD

(71) Applicant: CONTEC INC, Spartanburg, SC (US)

(72) Inventors: Layne Ross, Simpsonville, SC (US); Preston Roe, Lyman, SC (US)

(73) Assignee: CONTEC INC., Spartanburg, SC (US)

( * ) Notice: Subject to any disclaimer, the term of this patent is extended or adjusted under 35 U.S.C. 154(b) by 454 days.

(21) Appl. No.: 17/298,567

(22) PCT Filed: Dec. 9, 2019

(86) PCT No.: PCT/US2019/065186

§ 371 (c)(1),
(2) Date: May 29, 2021

(87) PCT Pub. No.: WO2020/123359

PCT Pub. Date: Jun. 18, 2020

(65) Prior Publication Data

US 2022/0015599 A1 Jan. 20, 2022

Related U.S. Application Data

(60) Provisional application No. 62/777,330, filed on Dec. 10, 2018.

(51) Int. Cl.

| | |
|---|---|
| ***A47L 13/20*** | (2006.01) |
| ***A47L 13/22*** | (2006.01) |
| ***A47L 13/256*** | (2006.01) |
| ***A47L 13/44*** | (2006.01) |

(52) U.S. Cl.

CPC ..... *A47L 13/22* (2013.01); *A47L 13/256* (2013.01); *A47L 13/44* (2013.01)

(58) Field of Classification Search

CPC ..... A47L 13/20; A47L 13/256; A47L 13/44; A47L 13/58

See application file for complete search history.

(56) References Cited

U.S. PATENT DOCUMENTS

| | | | | |
|---|---|---|---|---|
| 8,087,121 | B1 * | 1/2012 | Michelson | A47L 13/14 15/228 |
| 8,677,547 | B1 * | 3/2014 | Morad | A47L 13/20 15/228 |
| 2011/0010885 | A1 * | 1/2011 | Tseng | A47L 13/58 15/260 |

(Continued)

OTHER PUBLICATIONS

International Search Report for PCT/US2019/065186.

*Primary Examiner* — Michael D Jennings
(74) *Attorney, Agent, or Firm* — J.M. Robertson LLC

(57) ABSTRACT

A mop head with a structural base and a resilient, compressible cover defining an internal void volume forming a reservoir that can be at least partially filled with a cleaning liquid through a surface opening in the cover. The structural base includes one or more liquid discharge channels which are normally closed off by spring-biased stopper members to prevent discharge of the cleaning liquid. The cleaning liquid may be selectively discharged by application of compressing force against the cover during use. The application of such compressing force displaces the stopper members thereby opening the liquid discharge channels and permitting the cleaning liquid to flow outwardly through the discharge channels and away from the mop head.

20 Claims, 4 Drawing Sheets

(56) References Cited

U.S. PATENT DOCUMENTS

| | | | | |
|---|---|---|---|---|
| 2011/0277259 | A1* | 11/2011 | Chen | A47L 13/20 15/228 |
| 2012/0047675 | A1* | 3/2012 | Chu | A47L 13/58 15/260 |
| 2012/0167321 | A1* | 7/2012 | Lee | A47L 13/58 15/119.1 |
| 2012/0222226 | A1* | 9/2012 | Chen | A47L 13/58 15/98 |

* cited by examiner

RESERVOIR MOP AND RELATED METHOD

CROSS-REFERENCE TO RELATED APPLICATION(S)

This nonprovisional application claims the benefit of, and priority from, provisional application 62/777,330 having a filing date of 10 Dec. 2018. The teachings of such prior application are hereby incorporated by reference as if set forth herein in its entirety.

TECHNICAL FIELD

The present disclosure relates generally to cleaning products, and more particularly to a mop tool incorporating a compressible hollow mop head defining an internal reservoir for liquid which can be expelled in a controlled manner by a user during a cleaning operation. The mop head also incorporates a lower surface adapted for reversible engagement with a disposable or reusable textile cleaning element.

BACKGROUND

Mopping is a well-known technique for cleaning floors and other surfaces. Often it is desirable to apply a liquid to the surface being cleaned during the mopping operation to act as a solvent and aid in the dissolution and removal of dirt. This liquid has traditionally been carried in a bucket or other container separate from the mopping tool. However, some users may find the use of a separate bucket to be undesirable due to issues such as spillage, contamination, and the like.

As an alternative to traditional bucket-based cleaning systems it is generally known to use reservoir structures that are attachable to the handle of the mopping tools and which feed liquid to the cleaning head through tubes or other suitable channels when activated by a user. It is also known to use mopping tools with hollow reservoir handles which can be filled with cleaning liquid for discharge. Prior known reservoir systems for mopping tools typically rely on a combination of inter-connected mechanical or electrical linkages that control valves or pumps to discharge a cleaning fluid by pumping force or gravity when the valves are simultaneously opened.

In prior known devices, filling the reservoirs may require ancillary dispensing systems and/or constant refilling of the system through small fill points. By way of example, in some systems a user is required to pour liquid into a relatively small opening in the elongated handle of the mopping tool while the handle is in a substantially vertical position. Such an operation may be difficult for many persons to perform without spillage. Moreover, such structures may require a relatively complex valve arrangement to permit an adequate volume of air to enter the reservoir to replace fluid as it is used. As will be appreciated, if enough air is not introduced into the fluid reservoir, fluid will be trapped and cannot be used. In addition, known current reservoir mops are typically triggered from the top of the handle by leaver, button, or other means. Mechanical or electrical linkages further complicate the design and may add considerable weight to the reservoir moping system.

In light of the various noted problems associated with known bucket and reservoir systems, an alternative construction for a mopping tool having an internal liquid reservoir system solely contained in the mop head would represent a useful advancement over the current art.

SUMMARY

In one exemplary construction, the present disclosure offers advantages and alternatives over the prior art by providing a mop tool incorporating a mop head with a structural base and a resilient, compressible cover defining an internal void volume forming a reservoir that can be at least partially filled with a cleaning liquid through a surface opening in the cover. The structural base includes one or more liquid discharge channels which are normally closed off by spring-biased stopper members to prevent discharge of the cleaning liquid. The cleaning liquid may be selectively discharged by application of compressing force against the cover during use, such as by downward pushing force applied through the mop pole (i.e. the handle) or a user's foot. The application of such compressing force displaces the stopper members thereby opening the liquid discharge channels and permitting the cleaning liquid to flow outwardly through the discharge channels and away from the mop head.

In accordance with one exemplary aspect, the present disclosure provides a liquid dispensing mop head having a structural base of one-piece molded plastic construction having an upper surface and a lower surface. The lower surface includes a plurality of hooking elements adapted to reversibly engage a textile structure in hook and loop connection. The structural base further includes at least one fluid discharge channel extending from the upper surface to an edge of the structural base such that fluid may flow from the upper surface to the edge for discharge away from the mop head. The structural base may further include a radially outward projecting raised lip disposed in elevated relation to the upper surface. A pliable one-piece molded polymer cover is disposed in covering relation over the structural base with a space between the cover and the structural base defining a fluid reservoir. The polymer cover includes at least one fluid opening adapted to receive fluid within the space between the cover and the structural base. The polymer cover further includes an integral connection structure adapted to engage a user manipulated pole. The polymer cover may include a tongue and groove seal disposed in stretched relation over the raised lip of the structural base. A stopper member is normally disposed in covering, flow-blocking relation to the fluid discharge channel at the upper surface of the structural base. The stopper member is operatively connected through a pivoting lever arm to a compressible spring normally applying an upward force to the lever arm and thereby urging the stopper member downward. The lever arm operatively engages the cover such that application of a downward force against the cover compresses the spring and raises the stopper member away from the fluid discharge channel to permit fluid flow through the discharge channel. Removal of the downward force against the cover causes the spring to urge the stopper member to return to covering, flow-blocking relation to the fluid discharge channel.

In accordance with one exemplary practice, it is contemplated that a mop tool consistent with the present disclosure need not require any mechanical or electrical linkages in the mop pole to actuate the release of fluid to the cleaning surface.

In accordance with another exemplary practice consistent with the present disclosure, it is contemplated the fluid storage and release structure may be housed exclusively in the mop head.

Other features and advantages of the disclosure will become apparent to those of skill in the art upon review of the following detailed description, claims and drawings.

Figure 1:
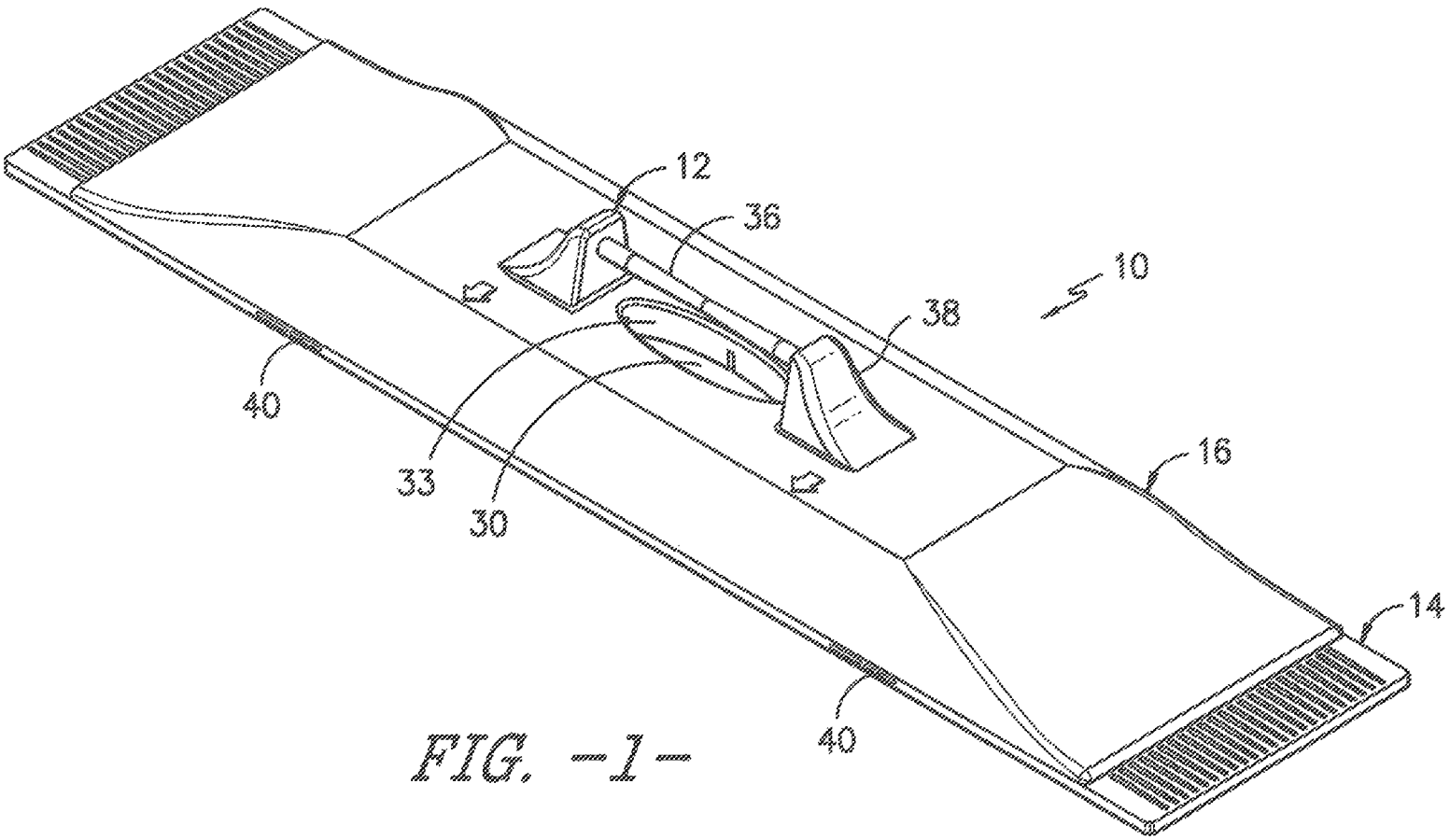
FIG. 1 is a schematic perspective view of an exemplary mop head consistent with the present disclosure.
Figure 2:
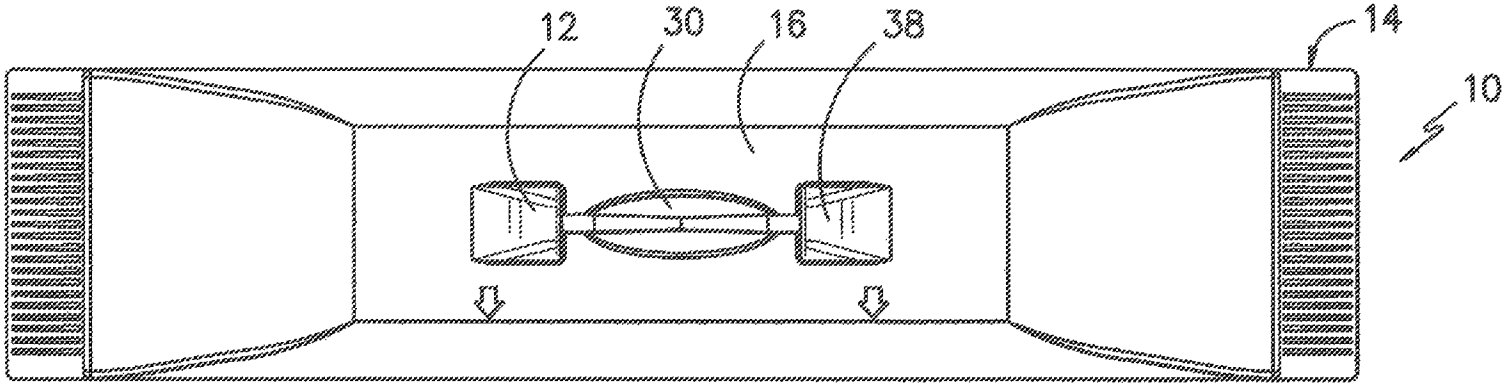
FIG. 2 is a schematic elevation view of the mop head of FIG. 1.

Before the exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENT(S)

Exemplary embodiments of the disclosure will now be described through reference to the drawings wherein like reference numerals are used to designate like elements in the various views. Referring now to the drawings, an exemplary mop head 10 (also referred to as a mop frame) is illustrated. As will be understood, the mop head 10 is adapted to be connected in pivoting relation to an elongated handle (not shown) which may also be referred to as a pole, through a suitable connection structure 12 as will be known to those of skill in the art to form a user-manipulated mop tool.

Figure 3:
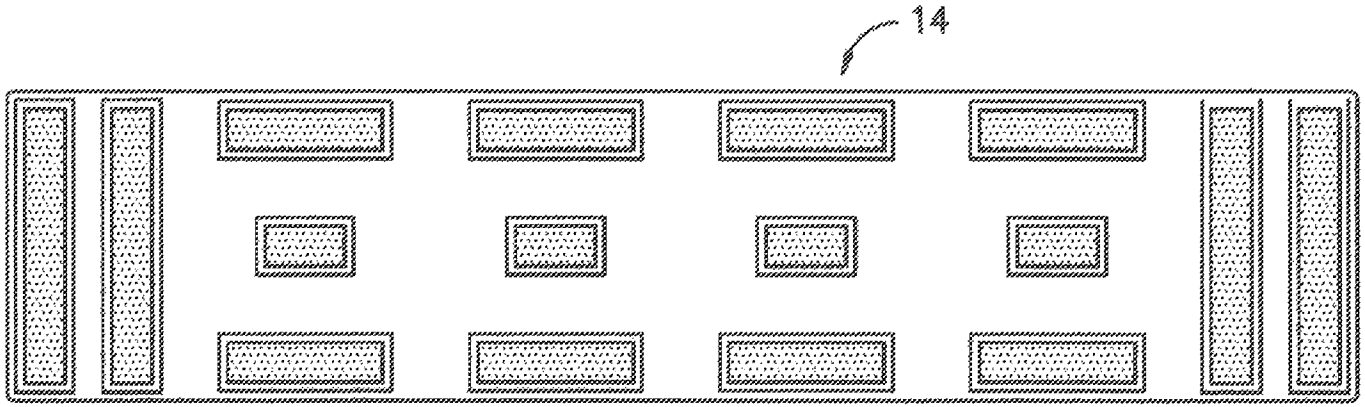
FIG. 3 is a schematic bottom view of the mop head of FIG. 1.
Figure 4:
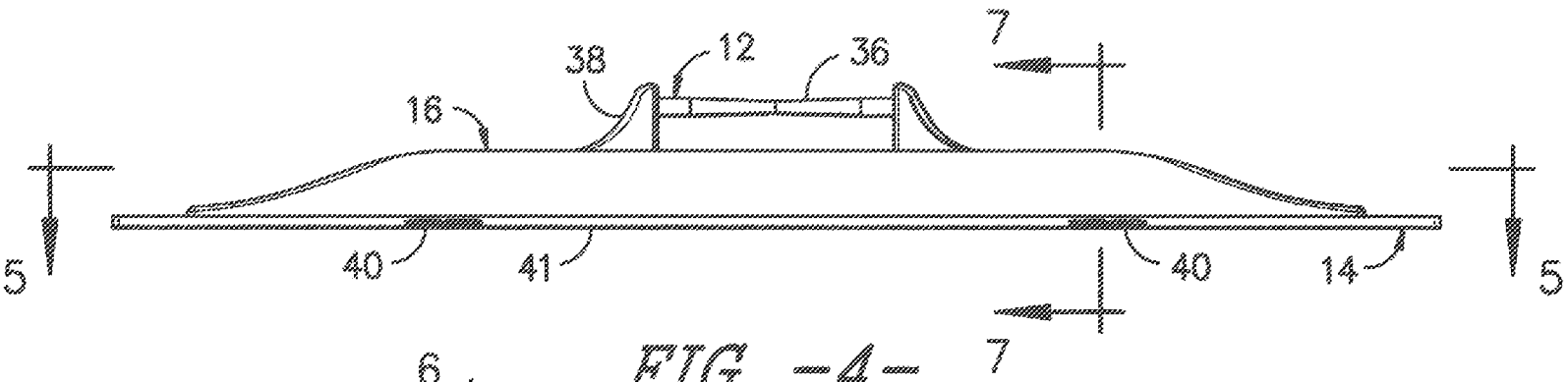
FIG. 4 is a schematic front view of the mop head of FIG. 1.

As shown, the illustrated exemplary mop head 10 includes a structural base 14 defining a substantially rigid bottom. Preferably, the structural base 14 is molded as a unitary one-piece structure from relatively rigid plastic. As seen in FIG. 3, the underside of structural base 14 may include a pattern of integral hooking zones defining micro-hook structures adapted to reversibly engage corresponding fiber elements on a single-use or multi-use cleaning textile. Of course, different patterns of hooking zones may likewise be used. A single hooking zone across all or part of the bottom surface may also be used if desired. Regardless of the pattern of hooking zones, a textile cleaning element (not shown) may be engaged using a hook and loop connection and can then be released after use by application of a separating shear force in a manner as will be well known.

As indicated previously, the mop head 10 also includes a compressible cover 16 of resilient and flexible rubber-like polymer material disposed in overlying relation to the structural base 14. By way of example only, and not limitation, the compressible cover 16 may be molded as a one-piece structure using suitable polymeric materials such as thermoplastic elastomer ("TPE"); thermoplastic polyurethane ("TPU") and the like. The material forming the compressible cover 16 is preferably substantially more flexible than the structural base 14.

Figure 6:
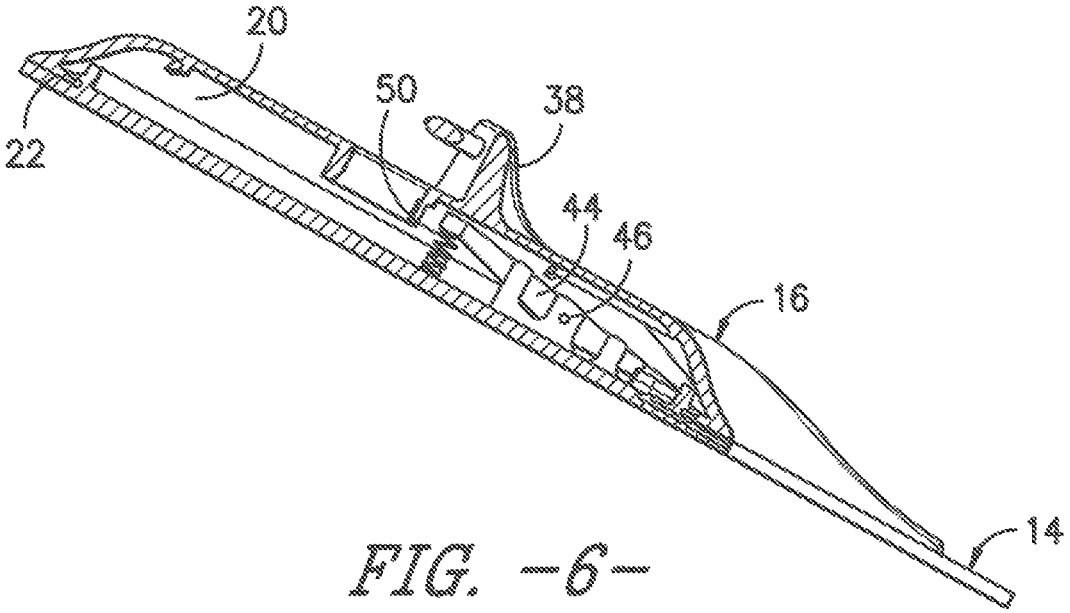
FIG. 6 is a schematic sectional view taken generally along line 6-6 in FIG. 5.
Figure 7:
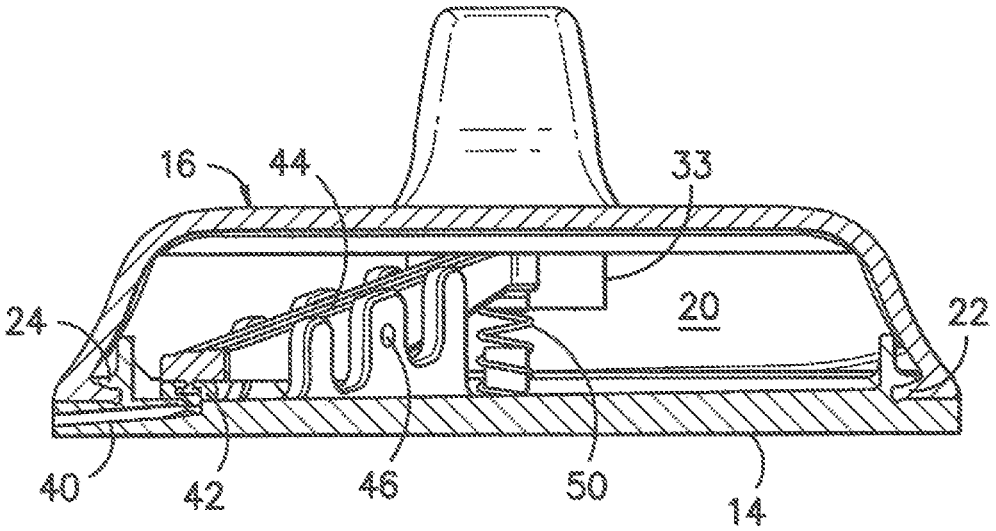
FIG. 7 is a schematic sectional view taken generally along line 7-7 in FIG. 4

In the illustrated exemplary construction, the cover 16 has a raised pyramid-shape profile with a substantially flat top and sloping sides. However, other geometries may also be used. As best seen in FIGS. 6 and 7, the cover 16 has a concave interior which defines an internal void volume 20 forming a fluid containment reservoir between the upper surface of structural base 14 and the cover 16. In the illustrated arrangement, the void volume 20 may be filled with a cleaning liquid such as an aqueous-based liquid or the like.

As best seen in FIG. 7, the flexible cover 16 may include an integrally molded inwardly projecting tongue and groove seal 22 which is stretched over an outwardly projecting raised lip 24 on the structural base 14 to form a liquid-tight seal between the structural base and the cover. The tongue and groove seal 22 and the outwardly projecting raised lip 24 may each be substantially continuous around a substantially matched defined perimeter In this arrangement, the inherent elasticity in the flexible cover 16 permits adequate stretching to allow the pliable inwardly projecting tongue and groove seal 22 to be stretched over the more rigid raised lip and to then snap into place under the raised lip. A fluid-tight seal is thereby formed around the entire perimeter. However, any other suitable sealing arrangement may likewise be utilized.

In accordance with one exemplary aspect of the present disclosure, the cover 16 may include one or more fill openings 30 in the upper surface. As will be appreciated, such fill openings permit a user to submerse a mop head in a cleaning liquid for filling using a traditional mopping bucket without any required ancillary filling equipment. In the illustrated exemplary construction, a single fill opening 30 of substantially oval geometry may be centrally positioned in substantial alignment with the connection structure 12. However, it is contemplated that multiple fill openings may be used if desired and that any number of alternative geometries and placement positions may likewise be used.

If desired, any fill openings may include a splashguard 33 such as a plastic ring or the like projecting downwardly around the perimeter of the opening and into the void volume 20. During use, the downwardly projecting splashguard 33 aids in preventing the liquid contained within the void volume from splashing back up through the fill opening. Such a splashguard 33 may be integrally molded with the cover 16 or may be a separate component attached by adhesives or other suitable techniques as may be desired.

As noted, the cover 16 may include an integral connection structure 12 for connection to a clamping portion of a mop pole (not shown) as will be well known to those of skill in the art. By way of example only and not limitation, one exemplary pole clamp which may be suitable for attachment is illustrated and described in U.S. Pat. No. 7,574,777 to Fuller, the contents of which are hereby incorporated by reference. However, it is likewise contemplated that any other clamping arrangement may likewise be utilized if desired.

In the illustrated exemplary construction, the connection structure 12 has a substantially stirrup shaped configuration with a cross bar 36 extending between a pair of upstanding post elements 38. However, it is contemplated that other constructions may also be used if desired. By way of example only, in one alternative construction, the cross bar 36 may be replaced by a pair of opposing lugs that each lug projects inwardly for attachment to a pole clamp without spanning the full width between the upstanding post elements 38. Regardless of the configuration used, it is contemplated that the connection structure used to engage the pole clamp may be integrally molded with the cover to form a one-piece unitary construction.

As noted previously, in the illustrated exemplary construction, the structural base includes one or more liquid discharge channels 40 (FIGS. 1 and 7) providing fluid communication between the internal void volume 20 and a forward edge 41 of the structural base. In this regard, it is to be understood that the term "forward edge" refers to the leading edge of the mop head 10 when being pushed forward by a user across a surface to be cleaned. The liquid discharge channels 40 are normally closed by spring-biased stopper members 42 at the upper surface of the structural base to prevent discharge of the cleaning liquid. In the exemplary construction, the stopper members 42 may be resilient pads of low durometer polymer such as TPE and or TPU adapted to seal off the interior openings to the liquid discharge channels in a manner similar to covering a drain opening.

Figure 5:
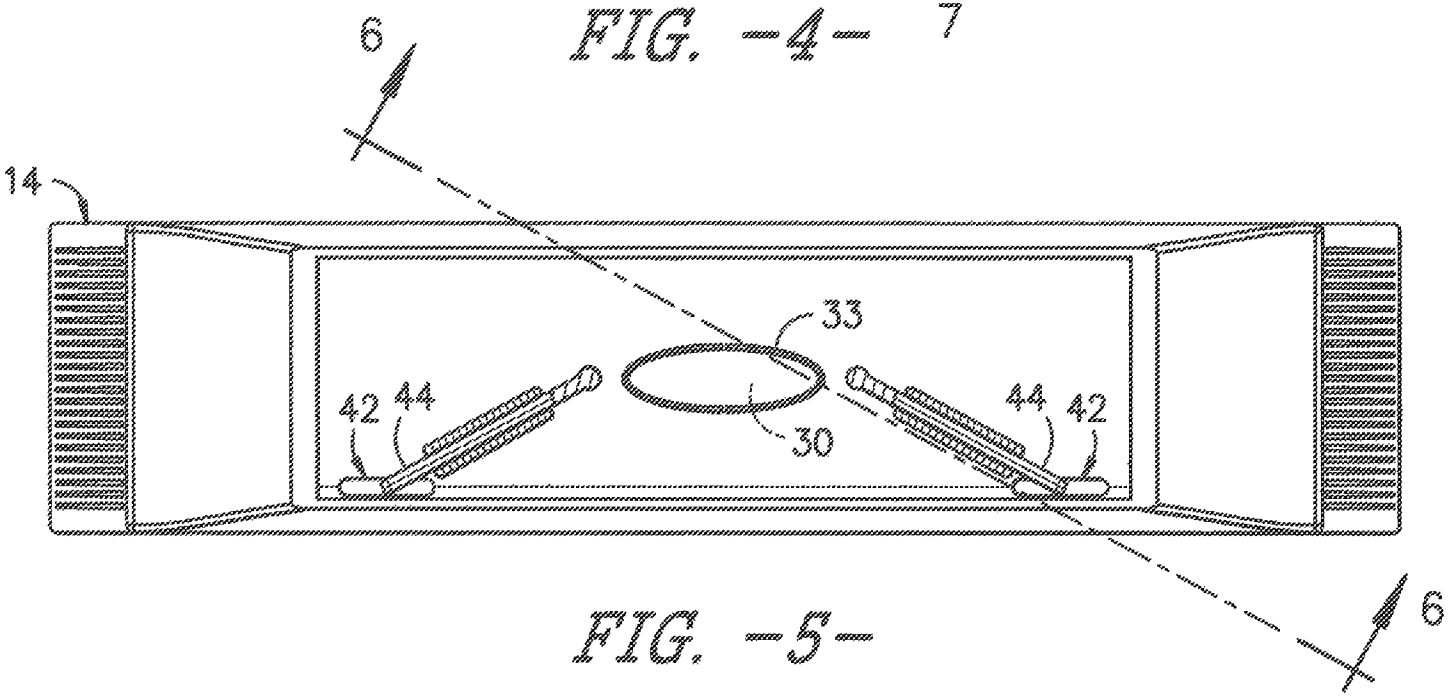
FIG. 5 is a schematic sectional view taken generally along line 5-5 in FIG. 4 illustrating internal spring-biased lever arms operatively connected to covering tabs to selectively open and close fluid passageways.

In the illustrated construction, the stopper members 42 may be held in place by spring-biased lever arms 44 supported at a fulcrum point 46. As best seen in FIG. 5, a corresponding arrangement may be provided on both sides of the mop head 10. As seen in FIG. 7, biasing springs 50 within the void volume normally apply a continuous force upwardly against the lever arms 44 to hold the stopper members 42 in place in blocking relation to the liquid discharge channels 40. In the illustrated exemplary construction, the springs 50 are helical springs supported at the interior by posts projecting upwardly from the upper surface of the structural base 14. However, other spring arrangements including leaf springs and the like may likewise be used if desired.

In the exemplary construction, a downward compressing force to the cover 16 may deform the cover and be transmitted to the lever arms 44 such that the lever arms 44 are pivoted about fulcrum point 46 and the biasing springs 50 are compressed. The stopper members 42 are thereby raised away from the liquid discharge channels 40. In this regard, such downward force may be applied by a user through the attached mop pole and/or directly by lightly stepping on top of the resilient, deformable cover 16 with his or her foot. With the stopper members 42 in the raised condition, liquid can then flow out of the void volume 20 and through the liquid discharge channels 40. When the applied downward force is removed, the cover 16 resumes its original shape and the stopper members 42 are urged back into sealing relation to the liquid discharge channels 40 by the biasing springs 50.

As will be understood, when the application of downward force against the cover 16 opens the liquid discharge channels 40, gravity causes the liquid to flow outwardly in projectile fashion away from the mop head and to the surface being cleaned without the need for any additional driving force other than the naturally occurring fluid pressure. Efficient discharge may also be aided by sloping the liquid discharge channels 40 towards the forward edge 41 of the structural base 14. The upper surface of the structural base 14 may also be sloped downwardly towards the forward edge 41 to further promote complete liquid discharge if desired.

In accordance with one exemplary feature, it is contemplated that the fill openings 30 may remain open both for filling and during use of the mop head. That is, the fill openings may be free from any cover. This open arrangement facilitates a continuous supply of air to enter the void volume 20 as cleaning liquid is dispensed thereby promoting efficient flow through the liquid discharge channels 40.

In practice, a mop head consistent with the present disclosure will permit a user to fill the mop head 10 with a desired liquid through a surface opening by simply submersing the mop head in a bucket and to then selectively apply pressure against the cover 16 during a mopping operation to discharge the liquid at a leading edge of the mop head as needed. If internal maintenance or cleaning is required, the cover may be easily disconnected from the structural base and then be reattached for continued use. The present disclosure thus provides an elegant and highly efficient apparatus and technique for the discharge of liquid to a surface during a mopping operation.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A liquid dispensing mop head comprising:

a structural base of one-piece molded plastic construction having an upper surface and a lower surface, wherein the lower surface includes a plurality of hooking elements adapted to reversibly engage a textile structure in hook and loop connection, the structural base further including at least one fluid discharge channel extending from the upper surface to a forward edge of the structural base such that fluid may flow from the upper surface to the forward edge for discharge away from the mop head;

a pliable molded polymer cover disposed in covering relation over the structural base with a space between the cover and the structural base defining a fluid reservoir, the polymer cover including at least one fluid acceptance opening adapted to receive fluid within the space between the cover and the structural base;

a stopper member normally disposed in covering, flow-blocking relation to said at least one fluid discharge channel at the upper surface of the structural base, the stopper member being operatively connected through a pivoting lever arm to a compressible spring normally applying an upward force to the lever arm and urging the stopper member downward, and wherein the lever arm operatively engages the cover such that application of a downward force against the cover compresses the spring and raises the stopper member away from the fluid discharge channel and wherein removal of the downward force against the cover causes the spring to urge the stopper member to return to covering, flow-blocking relation to the fluid discharge channel.

2. The mop head as recited in claim 1, wherein said at least one fluid discharge channel extends in sloped relation from the upper surface to the forward edge of the structural base.

3. The mop head as recited in claim 1, wherein the upper surface of the structural base is sloped downwardly towards the forward edge of the structural base.

4. The mop head as recited in claim 1, wherein the polymer cover is a one-piece molded construction formed from a resilient polymeric material.

5. The mop head as recited in claim 4, wherein the structural base is more rigid than the polymer cover.

6. The mop head as recited in claim 5, wherein the polymer cover has a raised, pyramid geometry.

7. The mop head as recited in claim 5, wherein the polymer cover has a raised, pyramid geometry with a flat top and sloping sides.

8. The mop head as recited in claim 5, wherein the polymer cover further includes an integral molded connection structure adapted to engage a user manipulated pole.

9. The mop head as recited in claim 5, wherein the polymer cover includes an integral molded connection structure comprising a cross bar extending between upstanding posts adapted to engage a user manipulated pole.

10. The mop head as recited in claim 5, wherein the structural base includes a radially outward projecting raised lip disposed in elevated relation to the upper surface and wherein the polymer cover includes a tongue and groove seal disposed in stretched relation over the raised lip of the structural base.

11. The mop head as recited in claim 1, wherein the spring is a helical spring.

12. The mop head as recited in claim 1, wherein a splashguard projects downwardly from said at least one fluid acceptance opening and into the fluid reservoir.

13. The mop head as recited in claim 12, wherein the splashguard is a ring.

14. The mop head as recited in claim 1, wherein said at least one fluid acceptance opening is free from any covering.

15. A liquid dispensing mop head comprising:

a structural base of one-piece molded plastic construction having an upper surface and a lower surface, wherein the lower surface includes a plurality of hooking elements adapted to reversibly engage a textile structure in hook and loop connection, the structural base further including at least one fluid discharge channel extending in sloped relation from the upper surface to a forward edge of the structural base such that fluid may flow from the upper surface to the forward edge for discharge away from the mop head, the structural base further including a radially outward projecting raised lip disposed in elevated relation to the upper surface;

a pliable one-piece molded polymer cover of raised, pyramid geometry disposed in covering relation over the structural base with a space between the cover and the structural base defining a fluid reservoir, the polymer cover including at least one fluid opening adapted to receive fluid within the space between the cover and the structural base, the polymer cover further including an integral connection structure adapted to engage a user manipulated pole and wherein the polymer cover includes a tongue and groove seal disposed in stretched relation over the raised lip of the structural base, wherein the structural base is more rigid than the polymer cover;

a stopper member normally disposed in covering, flow-blocking relation to the fluid discharge channel at the upper surface of the structural base, the stopper member being operatively connected through a pivoting lever arm to a compressible spring normally applying an upward force to the lever arm and urging the stopper member downward, and wherein the lever arm operatively engages the cover such that application of a downward force against the cover compresses the spring and raises the stopper member away from the fluid discharge channel and wherein removal of the downward force against the cover causes the spring to urge the stopper member to return to covering, flow-blocking relation to the fluid discharge channel.

16. The mop head as recited in claim 15, wherein the upper surface of the structural base is sloped downwardly towards the forward edge of the structural base.

17. The mop head as recited in claim 15, wherein the spring is a helical spring.

18. The mop head as recited in claim 15, wherein a splashguard projects downwardly from said at least one fluid acceptance opening and into the fluid reservoir.

19. The mop head as recited in claim 18, wherein the splashguard is a ring.

20. The mop head as recited in claim 15, wherein said at least one fluid acceptance opening is free from any covering.

* * * * *